US007210411B2

(12) United States Patent
Booth et al.

(10) Patent No.: US 7,210,411 B2
(45) Date of Patent: May 1, 2007

(54) 4.6 MM SMALL ARMS AMMUNITION

(75) Inventors: Derek Booth, Crewe (GB); Adrian David Smith, Crewe (GB); Robert Ashley, Crewe (GB)

(73) Assignee: BAE Systems plc, London (GB)

( * ) Notice: Subject to any disclaimer, the term of this patent is extended or adjusted under 35 U.S.C. 154(b) by 200 days.

(21) Appl. No.: 10/492,982

(22) PCT Filed: Mar. 16, 2004

(86) PCT No.: PCT/GB2004/001111

§ 371 (c)(1),
(2), (4) Date: Apr. 16, 2004

(87) PCT Pub. No.: WO2004/085954

PCT Pub. Date: Oct. 7, 2004

(65) Prior Publication Data

US 2004/0244630 A1 Dec. 9, 2004

(30) Foreign Application Priority Data

Mar. 27, 2003 (GB) ..... 0307272.5

(51) Int. Cl.
*F42B 12/04* (2006.01)
*F42B 12/78* (2006.01)

(52) U.S. Cl. ..... 102/514; 102/524

(58) Field of Classification Search ..... 102/514, 102/501, 516, 511, 517, 524
See application file for complete search history.

(56) References Cited

U.S. PATENT DOCUMENTS 326,231 A * 9/1885 Manning ..... 102/501
711,209 A * 10/1902 Hill ..... 102/524
847,149 A * 3/1907 Barlow ..... 102/524
996,820 A * 7/1911 Wray ..... 102/524
1,582,673 A * 4/1926 Fahrenwald ..... 148/432
3,349,711 A * 10/1967 Darigo et al. ..... 102/509
4,619,203 A * 10/1986 Habbe ..... 102/516
5,686,693 A 11/1997 Jakobsson
6,090,756 A * 7/2000 Brown ..... 508/118
6,293,203 B1 9/2001 Alexander et al.
D456,480 S * 4/2002 Quinsa et al. ..... D22/116

(Continued)

FOREIGN PATENT DOCUMENTS

DE 309293 * 1/1920

(Continued)

*Primary Examiner*—James S. Bergin
(74) *Attorney, Agent, or Firm*—Nixon & Vanderhye P.C.

(57) ABSTRACT

A round of ammunition for firing from a gun having a rifled barrel, especially a small arms weapon. The projectile (1) forming a part of the round is of steel or other material having a Vickers Hardness value not less than 550, and has a coating (13) of copper or copper alloy. The projectile has a forward body portion (9) which has a diameter similar to that of the lands of the rifling, and a rearward body portion (3) having a diameter which is similar to the diameter defined by the roots of the rifling grooves. The coating (13) is of a thickness not less than the depth of the said rifling grooves, so that the rifling engraves the coating but does not significantly engrave the underlying steel or other hard material. The advantages associated with a hard projectile material are thus obtained without substantially increasing barrel wear.

24 Claims, 3 Drawing Sheets

U.S. PATENT DOCUMENTS

| | | | | |
|---|---|---|---|---|
| 6,374,743 | B1 * | 4/2002 | Hug et al. | 102/518 |
| 6,439,125 | B1 * | 8/2002 | Carter | 102/507 |
| 6,973,879 | B1 * | 12/2005 | McElroy et al. | 102/514 |

FOREIGN PATENT DOCUMENTS

| | | | |
|---|---|---|---|
| DE | 2839120 A | * | 9/1982 |
| FR | 2 511 497 | | 2/1983 |
| FR | 2540239 A | * | 8/1984 |
| GB | 697172 | | 9/1953 |
| WO | WO 99/00468 | | 1/1999 |

* cited by examiner

4.6 MM SMALL ARMS AMMUNITION

This application is the US national phase of international application PCT/GB2004/001111, filed in English on 16 Mar. 2004, which designated the US. PCT/GB2004/001111 claims priority to GB Application No. 0307272.5, filed 27 Mar. 2003. The entire contents of these applications are incorporated herein by reference.

BACKGROUND OF THE INVENTION

1. Field of the Invention

This invention relates to ammunition for use in a weapon having a rifled barrel, and especially to an improved form of projectile for small arms ammunition.

2. Discussion of Prior Art

When a projectile is fired from a rifled barrel, the projectile must deform as it travels along the barrel so that material forming part of the projectile is forced into the spaces between the lands forming the rifling. This process is called engraving, and causes a spin to be imparted to the projectile by virtue of the longitudinal twist of the rifling.

The deformation of the projectile, its travel along the barrel effectively as a force fit to the rifling, the high linear acceleration imparted by the gun propellant on firing, and the consequent high rate of angular acceleration and associated force acting between rifling and projectile all contribute to substantial wear on the barrel.

If this wear rate can be reduced, substantial benefits follow, including increased barrel life, higher muzzle velocity and hence increased accuracy and lethality.

For this reason, low friction, readily deformable materials are normally selected for small arms bullets, for example lead. In order to increase the overall density of the bullet, it has also been proposed to use steel. However, steel is not readily deformable, and causes unacceptable barrel wear. On the other hand, hardness is a very desirable characteristic for the bullet material, in order to minimise nose tip ablation during penetration of hardened targets such as, for example, titanium/kevlar body armour. For these purposes, a Vickers Hardness of at least 550 (using a 10 kg load) is the minimum desirable.

In seeking to overcome these problems, it has been common practice to make a small arms bullet from a steel core, enclosed in a gilding metal jacket.

This latter solution is practical, but results in a bullet having a relatively expensive construction. This is a very significant disadvantage since small arms ammunition is consumed in large quantities, and the market for such ammunition is highly competitive.

In U.S. Pat. No. 5,686,693 there is disclosed a 7.62 mm bullet formed from a steel alloy, having a forward body portion whose diameter corresponds to that of the rifling lands of an associated gun, and a rearward body portion having a greater diameter, and provided with annular grooves. The body is provided with a coating which can be of copper. In use, the copper coating acts as a lubricant, and is less thick than the depth of the rifling. When fired from the rifled barrel, the rifling therefore cuts through the copper coating so that the steel body of the bullet is engraved by the rifling. In the disclosure it is stressed that the steel of the body must be soft, so as to permit this engraving to occur without undue barrel wear. The maximum value for the hardness of the steel body mentioned in the disclosure is 210 Brinell, which equates to a Vickers Hardness of 213, i.e. very much less than the desirable minimum value of 550 Vickers Hardness. As a result, the bullet disclosed in U.S. Pat. No. 5,686,693 will lack the desirable hardened target penetration capability.

It would therefore be a considerable advantage if a way could be found to utilise steel or other metal having a Vickers Hardness equal to at least 550 (using a 10 kg load) as the principal component of a small arms projectile, while enabling the projectile to be engraved by the rifling and not introducing unacceptable friction or wear, and avoiding the expensive construction of applying a jacket to the projectile.

SUMMARY OF THE INVENTION

According to the present invention there is provided the combination of a gun having a rifled barrel and a round of ammunition; the rifling of the barrel comprising rifling grooves which are separated by lands extending helically along the length of the barrel; the round of ammunition comprising a projectile; the projectile having a body comprising a substantially cylindrical body, and at least one annular groove formed in and encircling the said substantially cylindrical body; the projectile further being provided with a coating of copper or copper alloy; wherein the body of the projectile is formed from a metal having a Vickers Hardness of not less than 550, and the coating is of a thickness not less than the depth of the said rifling grooves.

Normally, the projectile will also have an ogival nose portion of the body forward of said forward body portion, although other forms are possible.

The body of the projectile should normally have a diameter which is not greater than that defined by the roots of the grooves of the rifling. Upon engagement with the rifling the body is thus engraved, so that the material of the projectile is deformed, and thus engages with the lands, inducing spin in the projectile due to the twist of the rifling. This deformation gives the body an, interference fit with the rifling so as also to provide effective obturation by restricting or preventing the escape of propellant gases past the projectile via the rifling grooves. The length and precise diameter of the body should be designed with these factors in mind. Regard must also be taken to ensure that the force required to effect the engraving and to propel the projectile along the barrel is not excessive, and this is the reason why the diameter of the body should not normally be greater than that of the rifling groove. This force is substantially reduced by the said at least one annular groove formed in and encircling the body.

The depth of said at least one annular groove should preferably be between about 1% and 10% of the nominal diameter of the projectile, and an optimum design may be between 2% and 6%.

The material selected for the projectile body will depend partly upon the function which the projectile is to perform.

For a warshot ammunition nature to be used in combat conditions, steel is a suitable material, as it is inexpensive and can be readily formed into the desired shape, e.g. by a cold-forming process. Tungsten is another possible material because hardness is an important characteristic for target defeat, as are alloys of tungsten, and tungsten carbide.

The projectile is coated with copper or a copper alloy, which is more readily deformable than the material of the projectile body itself, and which may have a lower coefficient of friction. These factors can lead to a reduced engraving force with correspondingly lower barrel wear and higher muzzle velocity.

A coating thickness between 0.07 mm and 0.3 mm may be suitable. Such a coating could conveniently be applied by electroplating or by chemical deposition.

A coating thickness greater than 0.1 mm may be desirable.

Additionally, molybdenum disulphide may be applied as an outer coating, for example by a centrifugal deposition process.

The invention is particularly but not exclusively applicable to small arms weapons systems, having a nominal calibre of 20 mm or less, especially 9 mm or less.

BRIEF DESCRIPTION OF THE DRAWINGS

The invention will now be described by way of example only with reference to the accompanying drawings, of which:—

DETAILED DISCUSSION OF EMBODIMENTS

Figure 1:
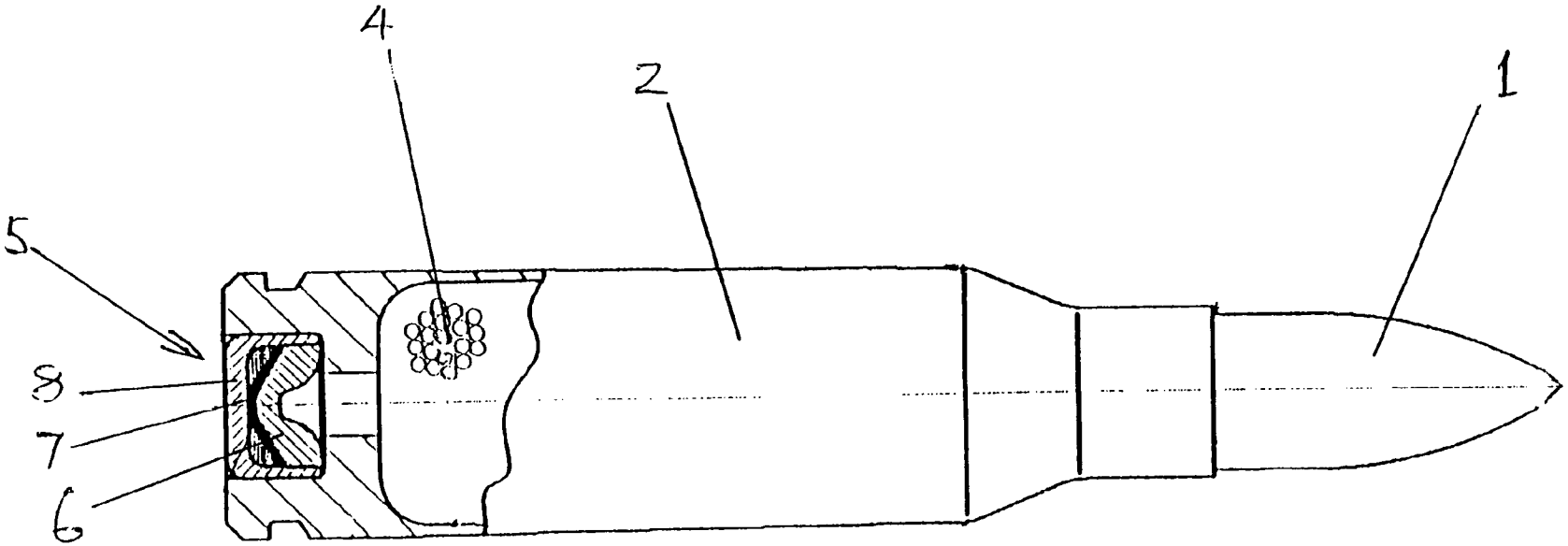
FIG. 1 shows, partially cut away, in elevation, a round of small arms ammunition incorporating a projectile for use in combination with a gun having a rifled barrel, in accordance with the invention.

As shown in FIG. 1, a round of small arms ammunition comprises a projectile 1, and a brass cartridge case 2 assembled thereto. The rearward portion 3 (FIG. 2) of the projectile is received within the forward part of the cartridge case, and the two components are held together by friction. The cartridge case contains a quantity of gun propellant material 4, and a percussion primer cap 5 comprising an anvil 6, a quantity of primary propellant 7 and a closure cap 8 which is received as a press fit in a recess in the rear end face of the cartridge case.

The projectile body is of elongate form and is cold formed from steel having a Vickers Hardness of at least 550 (using a 10 kg load). It can subsequently be given a heat treatment to provide the desired hardness or other physical properties. The projectile comprises a body portion 9 of substantially cylindrical form. The projectile also has a nose portion 10 forward of the portion 9, the nose portion 10 having an ogival forward end 11.

Because of the substantial hardness of the projectile body material, the projectile is highly effective at penetration of targets such as titanium/kevlar body armour. Moreover, the hardness also serves to minimise ablation of the projectile tip profile, thus further contributing to its effectiveness in target penetration, as well as stability in flight.

The body portion 9 comprises three parallel grooves 12 therein, which encircle the projectile, and the surface of the projectile is covered with a coating 13.

Figure 3:
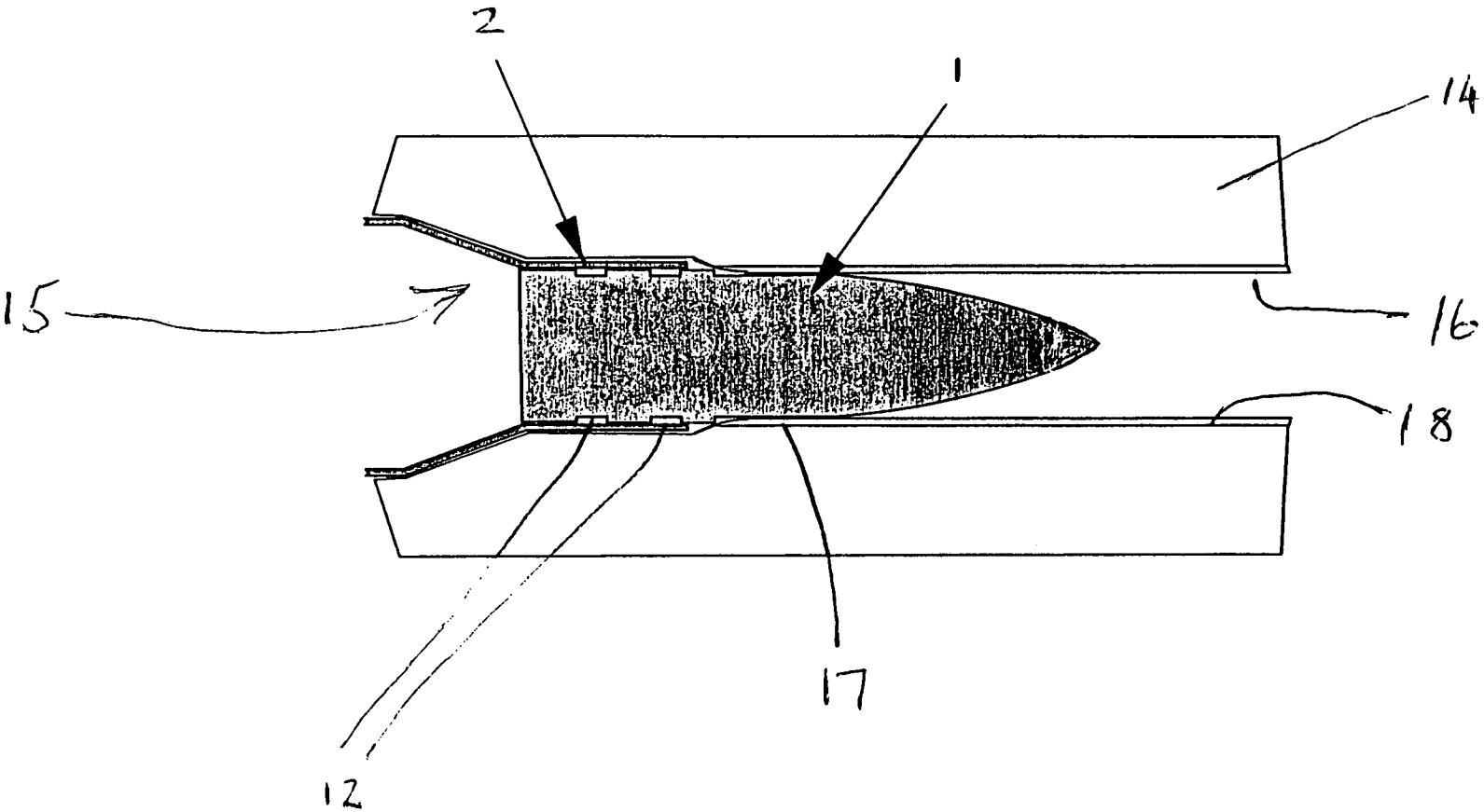
FIG. 3 shows, in sectional elevation, the projectile and part of the cartridge case located in the chamber of a gun having a rifled barrel and ready for firing.

As shown in FIG. 3, in use the round of ammunition comprising the assembled primed and filled cartridge case 2, together with the projectile 1 are fired from a gun having a rifled barrel 14, in the conventional manner, i.e. by chambering the round within the gun chamber 15, and arranging for the cap 5 to be struck by a firing pin.

The projectile is thus propelled down the gun barrel. The diameter of the body 9 and coating 13 together is greater that the diameter defined by the rifling lands 16 by an amount approximately half that of the deposited thickness of the coating 13 over the body 9.

When the body 9 and associated coating 13 passes from the gun chamber into the rifled part of the barrel, by virtue of its greater diameter, the body becomes engraved by the rifling 17. The diameter of the body 9 and coating 13 should preferably be substantially equal to or less than the diameter of the rifling grooves 18, while the grooves 12 can have substantially the same diameter as the barrel diameter.

The presence of the grooves 12 facilitates the necessary deformation of the coating 13, thus enabling the engraving to take place with a substantially reduced axial force. The fact that the coating 13 can deform into the grooves 12 contributes considerably to a dramatic reduction in the axial force required for engraving to occur.

The coating 13 is of a malleable material which can be copper or a copper alloy and could additionally comprise an outer layer of a low-friction material such as molybdenum disulphide. This coating 13 is of a thickness greater than the depth of the rifling grooves, and is of a relatively softer material than that of the projectile 1, it can also engrave more readily, and thus contribute for this reason also to a reduction in the engraving force required. Because the coating is thicker than the depth of rifling, engraving can take place entirely within the coating so that the hard metal of the projectile is kept substantially out of contact with the material forming the rifling of the gun barrel. Therefore, despite the hardness of the material forming the main part of the projectile body, barrel wear from this factor is minimised.

It will be evident to the skilled addressee that all of these factors reducing the engraving force will also result in reduced barrel wear, higher muzzle velocity, and hence increased lethality and accuracy.

The projectile which forms part of the combination of gun and ammunition tile according to the invention is also considerably less expensive to manufacture than a corresponding conventional projectile in, for example, a gilding metal jacket.

The optimum design parameters for the projectile according to the invention can be determined by those skilled in the art, based on the teaching contained herein.

The invention is particularly but not exclusively applicable to small arms ammunition. In one particular example, the invention has been successfully applied to 4.6 mm gun and ammunition. In a lodged bullet test, in which the force is measured which is required to dislodge a bullet which is stuck in the rifled section of a gun barrel, it has been found that a projectile made from steel having no reduced-diameter body portion 9 or suitable grooves into which a coating 13 can readily deform, would require an unacceptable axial force, with associated unacceptably high rate of barrel wear, and for this reason steel bullets, particularly those having considerable hardness, have not been considered practical hitherto.

Figure 2:
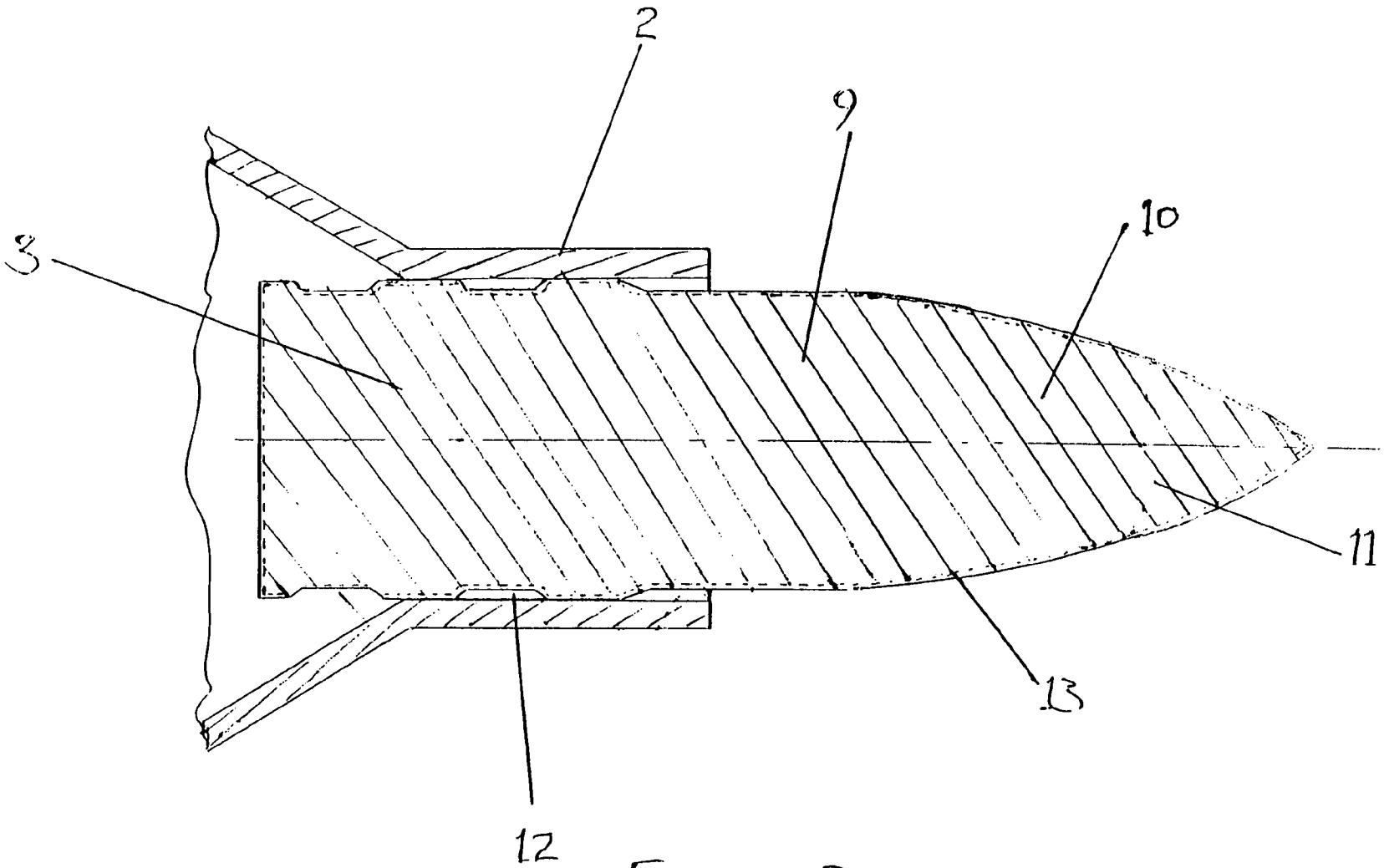
FIG. 2 shows, in sectional elevation, to an enlarged scale, the projectile and a part of the cartridge case of the round shown in FIG. 1.

A 4.6 mm projectile as described with reference to FIGS. 1 and 2, but without the grooves 12 was found to require an unduly high axial force of the order of 6000 N; addition of the grooves 12 reduced this force to 2000 N.

The invention claimed is:

1. A projectile for a gun having a rifled barrel, said projectile comprising a round of ammunition; the rifling of the barrel comprising rifling grooves which are separated by lands extending helically along the length of the barrel; the projectile having a body comprising:

a substantially cylindrical body, said body having a plurality of annular grooves formed therein;

a coating of copper or copper alloy substantially surrounding said body; wherein the body of the projectile is formed from a metal having a Vickers Hardness of not less than 550, and the coating is of a thickness not less than the depth of the said rifling grooves, wherein a portion of the coating is deformed into a portion of said annular grooves.

2. A projectile according to claim 1 wherein the projectile has an ogival nose portion of the body.

3. A projectile according to claim 1 wherein the depth of said annular grooves is between about 1% and 10% of the nominal diameter of the projectile.

4. A projectile according to claim 3 wherein the depth of said annular grooves is between about 2% and 6% of the nominal diameter of the projectile.

5. A projectile according to claim 1 wherein the projectile body is made of a material selected from the group comprising steel, tungsten, alloys of tungsten, and tungsten carbide.

6. A projectile according to claim 1 wherein the thickness of the coating is between 0.07 mm and 0.3 mm.

7. A projectile according to claim 1 wherein the thickness of the coating is greater than 0.1 mm.

8. A projectile according to claim 1 wherein the projectile has an outer coating of a material which has a lower coefficient of friction than that of the projectile body.

9. A projectile according to claim 8 wherein the said outer coating is of molybdenum disulphide.

10. A projectile according to claim 1 wherein the gun and the round of ammunition have a nominal calibre of 20 mm or less.

11. A projectile according to claim 10 wherein the said nominal calibre is 9 mm or less.

12. A projectile according to claim 11 wherein the said nominal calibre is 4.6 mm.

13. A combination of gun and ammunition having a projectile according to claim 1 wherein the diameter of the body portion is less than or equal to the diameter defined by said lands.

14. A combination according to claim 13 wherein the diameter of the body portion is substantially the same as the diameter defined by said lands.

15. A projectile for use in combination with a rifled barrel of a gun, the projectile having a body comprising:

a substantially cylindrical body portion, a plurality of annular grooves formed in and encircling said body portion;

a coating of one of copper and copper alloy substantially surrounding said body, wherein the body of the projectile is formed from a metal having a Vickers Hardness of not less than 550, and the coating is of a thickness between 0.07 mm and 0.3 mm, and wherein a portion of the coating is deformed into a portion of said annular grooves.

16. A projectile according to claim 15 wherein the depth of said annular grooves is between about 1% ad 10% of the nominal diameter of the projectile.

17. A projectile according to claim 15 wherein the projectile body is made of a material selected from the group comprising steel, tungsten, alloys of tungsten, and tungsten carbide.

18. A projectile according to claim 15 wherein the thickness of the coating is greater than 0.01 mm.

19. A projectile according to claim 15 wherein the projectile has an outer coating of a material which has a lower coefficient of friction than that of the projectile body.

20. A projectile according to claim 19 wherein the said outer coating is of molybdenum disulphide.

21. A projectile according to claim 15 having nominal calibre of 9 mm or less.

22. A projectile according to claim 21 wherein the said nominal calibre is 4.6 mm.

23. A projectile for a gun having a rifled barrel, the rifling of the barrel comprising rifling grooves which are separated by lands extending helically along the length of the barrel, the projectile comprising:

a substantially cylindrical body portion, said body portion formed from a metal having a Vickers Hardness of not less than 550, an outer diameter of said body portion is less than an internal diameter of the barrel, said body portion including a plurality of annular grooves; and a deformable coating comprised of one of copper and a copper alloy, said coating substantially surrounding said body portion; wherein said deformable coating and said annular grooves comprise a means for deforming a portion of said coating into a portion of said annular grooves during firing of the projectile.

24. A projectile according to claim 23, wherein said coating has a thickness greater than a depth of said rifling grooves.

* * * * *